United States Patent [19]

Wu

[11] 4,422,467

[45] Dec. 27, 1983

[54] COUPLING STRUCTURE OF THE UPPER NOTCH AND FERRULE ON AN UMBRELLA OR PARASOL

[76] Inventor: Tsun Z. Wu, No. 15, Lane 52, Ho-Ping West Rd., Section 3, Taipei, Taiwan

[21] Appl. No.: 371,828

[22] Filed: Apr. 26, 1982

[51] Int. Cl.[3] ..... A45B 25/10

[52] U.S. Cl. ..... 135/36 TP

[58] Field of Search ..... 135/25 R, 36 R, 36 F, 135/36 TP, 36 RT, 44, 34; 215/355

[56] References Cited

U.S. PATENT DOCUMENTS

| | | | |
|---|---|---|---|
| 337,003 | 3/1886 | Luedemann | 215/355 X |
| 2,927,709 | 3/1960 | Hoffman | 215/355 |
| 3,126,901 | 3/1964 | Norkin | 135/25 R |
| 3,362,556 | 1/1968 | Waldrum | 215/355 X |
| 3,613,702 | 10/1971 | Weber | 135/36 TP X |

FOREIGN PATENT DOCUMENTS

| | | | |
|---|---|---|---|
| 197982 | 5/1958 | Austria | 135/36 TP |

*Primary Examiner*—Harland S. Skogquist
*Attorney, Agent, or Firm*—McGlew and Tuttle

[57] ABSTRACT

A coupling structure of the upper notch and the ferrule on an umbrella or parasol is provided to improve upon the habitually used screw type. With a newly designed ring, the coupling of the ferrule with the upper notch can be easily accomplished by pressing once. This saves effort and time. Once they are coupled, they will not become loose, thus preventing the ferrule from falling-off. If the umbrella falls to the ground due to carelessness, the ferrule and upper notch are not easily damaged or broken.

5 Claims, 26 Drawing Figures

COUPLING STRUCTURE OF THE UPPER NOTCH AND FERRULE ON AN UMBRELLA OR PARASOL

FIELD AND BACKGROUND OF THE INVENTION

The presented invention relates to an improvement of components in the upper notch and ferrule on an umbrella.

In the prior art, the customary adapting manner is to screwdrive the ferrule into the bed of the notch and lock it in. This connection can easily become loose and even fall off. The conventional screw type arrangement has either a convex (knoblike) notch with a concave ferrule or a concave notch with a convex ferrule. The ferrule, when the notch is convex is linked by a female screw in a caplike shape. And the ferrule, when the notch is concave, is coupled by a male screw in a protruding manner. In daily use, the umbrella ferrule often becomes loose and falls off. When it becomes loose, the umbrella user may lose it without notice at any time. And if the ferrule touches the ground due to carelessness, since a gap is created between the ferrule and the notch due to the loosening, the moment the ferrule touches the ground, the impact force is absorbed by the ferrule tube itself and therefore the screw groove is damaged, at least. If the impact is serious, the umbrella ferrule will be damaged or broken. With a broken ferrule, an umbrella looks not only in bad shape (it is not easy to find a repair shop or vendor nowadays), but also the ferrule is easily lost. The boss or notch extends forward when the umbrella is being used, posing a threat to the safety of the user as well as other people near him. This is not even to mention the risk created by a damaged umbrella where the knoblike projection of the umbrella could cause unpleasantries if it unintentionally contacts other people or scratches other people's clothing or belongings. In addition, as a result of keen competition in the umbrella industry, there is strict control of production costs and most manufacturers adopt automation to mass produce umbrellas at low costs. The traditional screw-type coupling structure wastes a lot of time. From the viewpoint of mass production, it is very uneconomical to spend a large amount of time in assembling the conventional notch and ferrule structure, because it increases production costs. This challenges the professionals to improve the coupling parts. Until now, there have not been any improvements disclosed in the field. The reason is clear. Under the principle of cost-effective production, new breakthroughs in the coupling structure of umbrellas become increasingly remote.

SUMMARY OF THE INVENTION

The principle object of the present invention is to provide a coupling structure of the upper notch and the ferrule on an umbrella in which the notch and the ferrule in an unique coupling manner. No matter whether the notch and the ferrule is rigid or flexible by nature, they can be coupled together in that the ferrule imbeds in the notch firmly.

Another object of the present invention is to disclose a coupling structure of the upper notch and the ferrule on an umbrella wherein an impact force will be absorbed by a flat and large area of the upper notch and the ferrule so as to prevent them from damage or deformation when the umbrella drops onto the ground due to carelessness.

A further object of the present invention is the provision of such a coupling structure of the upper notch and the ferrule on an umbrella in which the upper notch with the ferrule can easily be connected to each other by pressing once.

Other further objects of the invention will become apparent upon a reading of the detailed specification hereinafter following and by reference to the drawings annexed hereto.

BRIEF DESCRIPTION OF THE DRAWINGS

FIG. 4 is an exploded view of a fourth embodiment of this invention.

FIGS. 6A and 6A1 are longitudinally sectional views of the sealing flexible ring of a sixth embodiment according to the invention.

DETAILED DESCRIPTION OF THE INVENTION

Figure 1A:
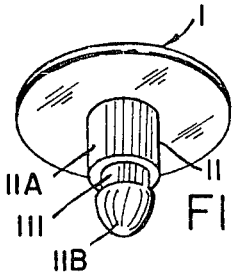
FIGS. 1A and 1B are perspective views which form an exploded view of a coupling structure of the ferrule and the upper notch on an umbrella to depict individually the upper notch and the ferrule of a first embodiment according to the invention.

In the first embodiment of the presented invention as shown on FIG. 1, the ferrule 1 is made of a rigid material but the upper notch 2 is of flexible material. In the body of the ferrule 1, there is an extrusive or projection part 11 having an upper section 11A, a lower section 11B and a middle section 111. The diameter of the middle section or stepped diameter area 111 is smaller than that of the upper and lower sections 11A and 11B. The upper notch or notch member 2 is connected to the umbrella tube 3 which has a middle opening 21 in which there is a protruding ring 211 at a selected position. The diameter of the central opening 21 equals the outer diameter of the upper section 11A of the projection or extrusive part 11 of the ferrule 1 but a little bit larger than the outer diameter of its lower section 11B. The inner diameter of the protruding ring 211 approximately equals the outer diameter of the middle section 111 of the extrusive part 11 of the ferrule 1 but is smaller than that of the lower section 11B and much smaller than that of the upper section 11A.

Figure 1B:
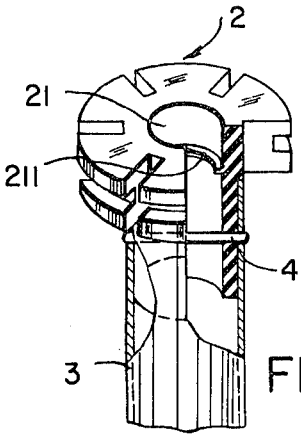
Figure 1C:
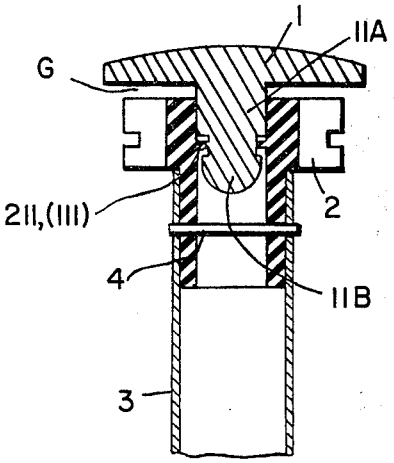
FIG. 1C is a longitudinally sectional view of a coupling structure of the upper notch and the ferrule on an umbrella of the first embodiment according to the invention.

Because the upper notch 2 and its protruding ring 211 in the central opening are made of the flexible material, it will be no problem for the ferrule 1 to be fitted into the upper notch 2 when the extrusive parts including lower section 11B, middle section 111 and upper section 11A are pushed into the central opening 21 of the upper notch 2. To push against the protruding ring 211, the extrusive parts are clogged due to the larger size of the lower section 11B. However, because of the flexibility of the protruding ring 211, the lower section 11B which is tapered smoothly can be forced through the inner diameter of the protruding ring 211 and then arrive at the downward part of the central opening 21 as shown in FIG. 1C. At that point, the ferrule 1 will not be loosened easily under normal conditions unless it is pulled upwardly with great force.

Figure 2A:
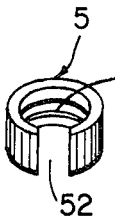
FIGS. 2A and 2B are perspective views which form an exploded view of the flexible ring and upper notch of a second embodiment according to this invention.

Between the bottom surface of the ferrule 1 and the top surface of the upper notch 2, there is a gap G (FIG. 1C) for the covering of the umbrella cloth (not shown). According to the improvement of the structure of the umbrella in accordance with this invention, in addition to the above mentioned advantages, the impact of the force when it drops to the ground due to carelessness on the part of the user will be absorbed by the bottom part of the ferrule 1, the umbrella cloth and the top part of the upper notch 2. Because the ports that sustain the falling strength are all of flat shape and large area, its falling to the ground will not cause any deformation and breakages to the components of umbrella. The second embodiment of the presented invention as shown on FIG. 2 is now described. The ferrule 1 is made of rigid material as in FIG. 1A and also the upper notch 2A is rigid. Since both are made of rigid material, their coupling is not easy and they are apt to break away during the coupling. In the inner wall of the central opening 21A of the upper notch 2A, there is a circular groove 211A. A flexible ring 5 as shown in FIG. 2A is fitted in the groove 211A. In addition to its flexibility, a protruding ring 51 is formed in the inner wall of ring 5. The inner diameter of the protruding ring 51 is smaller than the diameter of the central opening 21A of the upper notch 2A. The flexible ring 5 has a slit 52 and hence the outer diameter of the ring 5 can be reduced with the provision of the slit 52. It is easy to fit it in the circular groove 211A in the opening of the upper notch 2A. Once it is inserted in the groove 211A, the flexible ring can automatically expand via its flexibility and therefore the coupling between the ring 5 and the circular groove 211A is very firm. When the flexible ring or ring member 5 is embedded in the circular groove 211A of the upper notch 2A, the protruding ring or ring part 51 extends into the central opening 21A, the function of which corresponds to that of the protruding ring 211 of the upper notch 2 as shown in FIGS. 1B and 1C. The insertion of the ferrule 1 resembles that in FIG. 1. In order to avoid the repetition of the same statement, a detailed description is omitted thereof.

The third embodiment according to the presented invention is shown in FIG. 3. The ferrule 1A (FIG. 3A) is of a hat-like configuration having an upward and a downward part, both parts are of horizontal flat type, contrary to the ferrule 1 of the first and second embodiments as shown in FIG. 1A. The ferrule 1A and upper notch 2B are made of rigid material. In the central opening 12A of the ferrule 1A, the inner wall surface provides a ring-like groove or stepped diameter area 121A for receiving a flexible ring 5 as shown in FIG. 3B. In order to accomodate to the structure of the ferrule 1A, the upper notch 2B is constituted of a projecting part 21B having a lower section 211B, a middle section 212B and an upper section 213B. The outer diameter of the lower section 211B equals that of the central opening 11 of the ferrule 1A but is larger than the inner diameter of the protruding flange 51 in the flexible ring 5. The upper section 213B has an arc and taper configuration, and its largest outer diameter is a little bit bigger than the inner diameter of the protruding flange 51. The diameter of the middle section 212B is smaller than the upper and lower sections 211B, 213B but corresponds to or is smaller than the inner diameter of the protruding flange 51.

The principle of coupling between the upper notch 2B and the ferrule 1A according to this embodiment is similar to that of the second embodiment as shown in FIG. 2 except that the female and male organs in the upper notch and the ferrule exchange position.

Figure 4A:
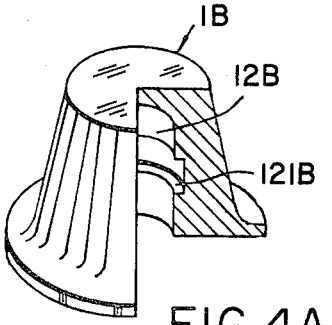
FIGS. 4A and 4B are perspective views respectively of a ferrule and an upper notch of a fourth embodiment of FIGS. 5A and 5B are respectively longitudinally partial perspective views of a coupling structure of the upper notch and the ferrule on an umbrella of a fifth embodiment according to the invention.
Figure 4B:
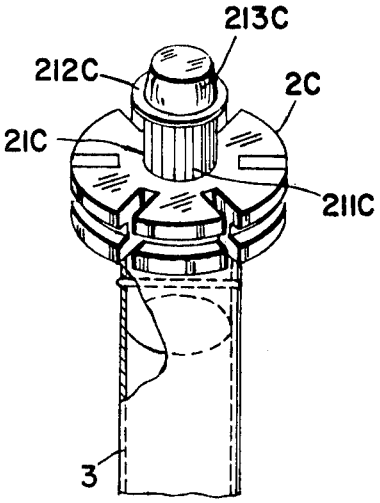

As shown in FIG. 4, the fourth embodiment according to the presented invention is similar to the third embodiment as shown in FIG. 3. The rigid ferrule 1B is of an extrusive configuration, a ring-like groove 121 is excavated in the inner wall of the central opening 12B of the ferrule. The upper notch 2C is flexible in nature and on top of it an upward body 21C is formed. The body 21C is constituted integrally by lower, middle and upper parts 211C, 212C and 213C. Among them, the outer diameter of the lower part 211C is approximately equal to the inner diameter of the central opening 12B of the ferrule 1B. The diameter of the middle part 212C is the largest and the outer diameter of the upper part 213C is smaller than that of the lower part 211C due to its cylindrical taper configuration.

When the ferrule 1B is fitted in the upper notch 2C, at the beginning it is clogged by the flange of the middle part 212C but due to the flexibility of the middle part, the said flange of said middle part 212C can be pushed and embedded in the groove 121B of the ferrule 1B to achieve the coupling function of both upper notch and ferrule.

The fifth embodiment of the present invention as shown in FIG. 5, uses a ferrule 1C which is rigid by nature. Its protruding body 10C is constituted integrally by upper, middle and lower parts 11C, 12C and 13C. Among them, the outer surface of upper part 11C has formed concave areas 111C with plentiful main longitudinal directions in order to meet the coupling function of the ferrule 1C and the upper notch 2D stated below. In this way, superfluous corrugated parts of the umbrella cloth (not shown) spread between the ferrule 1C and the upper notch 2D and can be inserted into concave areas 111C which enable the outward appearance of the umbrella to be clear neat and beautiful. The lower part 13C of protruding body 10C has the corresponding diameter part 131C closing to one side of middle parts 12C, the remaining part 132C being slantingly formed, therefore, the diameter of the corresponding diameter part 131C is larger than that of the part 132C.

The upper diameter of the ferrule protruding body 10C is approximately equal to the inner diameter of middle hole 21D located on upper parts of the upper notch 2D stated below but larger than the diameters of middle parts 12C and lower part 132C. The diameter of the corresponding diameter part 131C is slightly bigger than the inner diameter of the protruding ring 211D extending from an inner wall surface of the middle hole 21D located on upper parts of the upper notch 2D. The diameter of the middle part 12C is smaller than inner diameter of the protruding ring 211D of said upper notch 2D.

The flexible upper notch 2D is of an extrusive configuration. Space 212D is pre-made between the protruding ring 211D and the inner wall surface of the middle hole 21D formed on top of the protruding ring 211D. The diameter of the middle hole 22D formed on the lower section of the lower part of the protruding ring 211D is approximately equal to the corresponding diameter part 131C of the ferrule protruding body 10C.

Figure 5A:
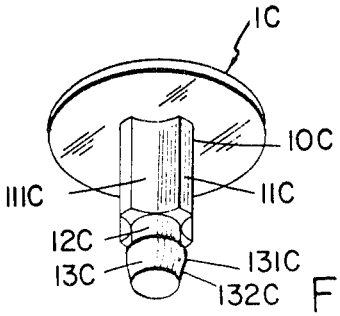
FIG. 5C is a sectional view of the fifth embodiment when the ferrule is partly inserted into upper notch, deflecting the flexible ring and enable it be expanded.
FIG. 5D is a sectional view of a coupling structure of the upper notch and the ferrule on an umbrella after the ferrule and the upper notch have been coupled to each other.
Figure 5C:
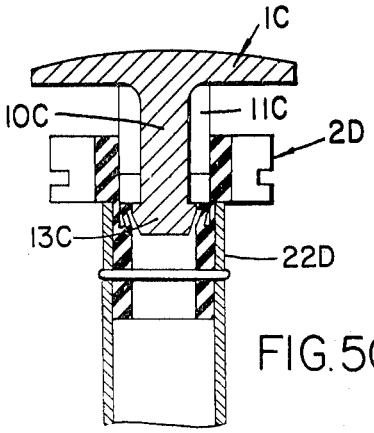
Figure 5B:
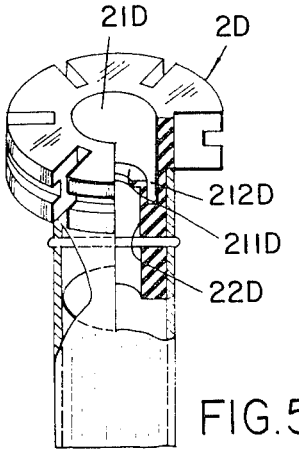

At the beginning when ferrule 1C is inserted into the upper notch 2D as shown in FIG. 5C, the upper part 11C of the protruding body seems just to be able to be inserted into the middle hole 21D formed on top of the upper notch. The lower part 132C has been inserted into the protruding ring 211D of the upper notch. Yet since the diameter of corresponding diameter part 131C is a little bit bigger than the inner diameter of the protruding ring 211D of said upper notch, it can communicate with the upper surface of the protruding ring 211D.

Figure 5D:
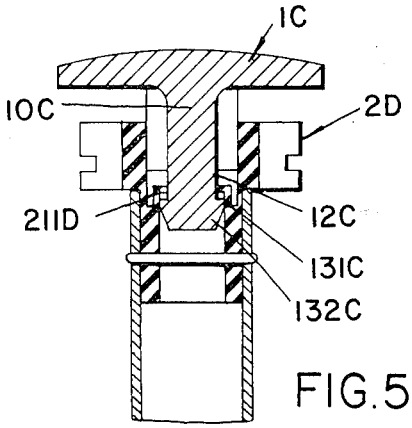

If slight stress is put on the ferrule 1C, then the corresponding diameter part 131C of lower part of the ferrule protruding body 10C will push the protruding ring 211D of said upper notch. Under this pressing condition, the protruding ring 211D will expand outwardly by means of its own flexibility, namely, to the extent of space 212D. At this time, the inner diameter of the protruding ring 211D of said upper notch 2D will be naturally enlarged to accomodate with the insertion of corresponding diameter part 131C of lower part of said ferrule protruding body 10C. After the middle part 12C of the ferrule protruding body 10C has inserted into the protruding ring 211D of the upper notch, and owing to the fact that the diameter of its middle part 12C is smaller than that of the protruding ring 211D, the protruding ring 211D, then, automatically returns to the original diameter by way of its own flexibility. Meanwhile, the corresponding diameter part 131C of lower part of the ferrule protruding body 10C has passed through the protruding ring 211D of the upper notch 2D and is seated under the lower part of the protruding ring 211D. The coupling function operated by the ferrule 1C and the upper notch 2D have nearly approached the status as shown in FIG. 5D. Since the corresponding diameter part 131C of lower part of the ferrule protruding body is clogged by the protruding ring 211D of said upper notch, the ferrule 1C will not so easily drop out in the longitudinal direction.

The sixth embodiment of the present invention as shown in FIG. 6 is similar to the second embodiment as shown in aforementioned FIG. 2. The ferrule is either rigid or flexible by nature. The ferrule in the sixth embodiment is held by a closing flexible ring 5A. In cross-section the protruding ring 51A formed from the inner wall has a thickness specified to be "T" as shown in FIG. 6A1.

Figure 2B:
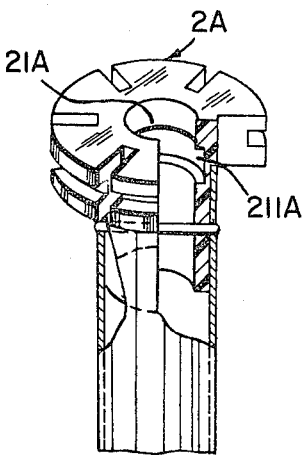
Figure 2C:
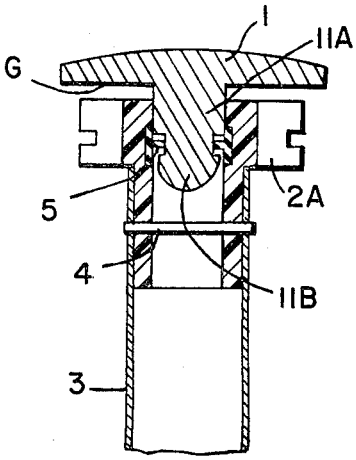
FIG. 2C is a longitudinally sectional view of the second embodiment of a coupling structure of the upper notch and the ferrule on an umbrella according to the invention.
Figure 3A:
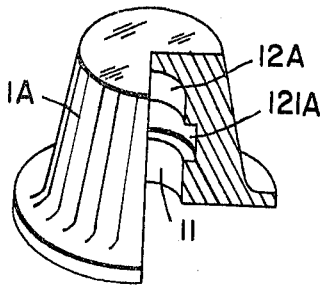
FIGS. 3A, 3B and 3C are perspective view of a ferrule, flexible ring and upper notch of a third embodiment according to the invention.
Figure 3B:
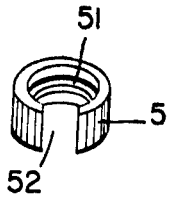
Figure 3C:
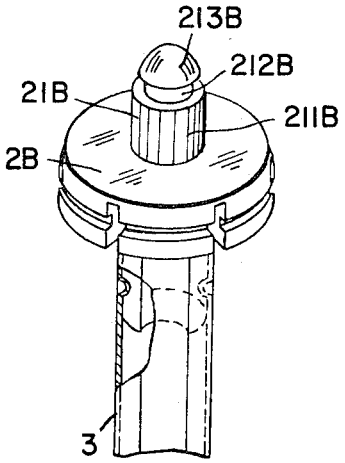
Figure 3D:
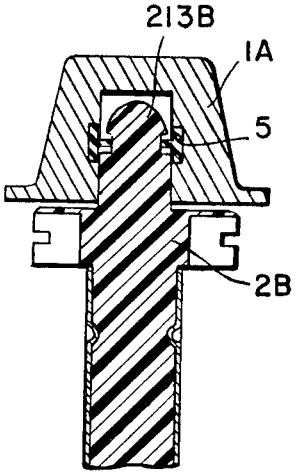
FIG. 3D is a longitudinally sectional view of the third embodiment of the invention.

The upper notch 2A shape is similar to that as shown in FIG. 2B. In upper notch 2A, on its inner wall of the middle hole 21A, a ring-like groove 211A is formed. The diameter of the ring-like groove 2 is shown at "H" to accomodate flexible ring 5A. After the flexible ring 5A has been contained in the ring-like groove 211A of the upper notch 2A, a space is lift between the outer boundaries of the of flexible ring 5A and the wall surface of a ring-like groove 211A as shown in FIG. 6D.

If we suppose the diameter of lower part 11B of the protruding body of the ferrule 1 as W, then its size should be $H \geqq W+2T$. At the beginning when the ferrule 1 has inserted into the upper notch 2A as shown in FIG. 6C, the diameter of lower part 11B of said protruding body is bigger than the inner diameter of the protruding ring 51A of flexible ring 5A, so the former is jammed or clogged by this flexible ring 5A.

Figure 6A:
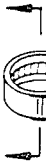
Figure 6A:
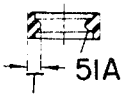
Figure 6C:
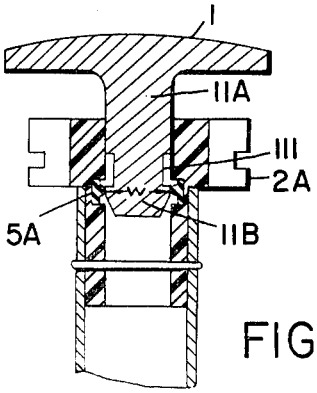
FIG. 6C is a sectional view of a coupling structure of the upper notch and the ferrule on an umbrella of the sixth embodiment during the coupling operation.
Figure 6B:
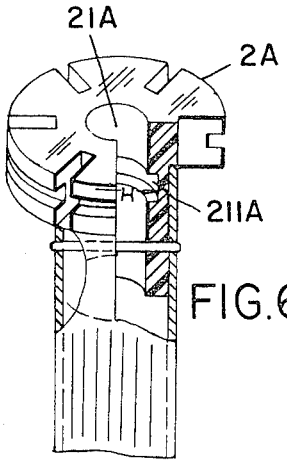
FIG. 6B is a perspective view of the upper notch for receiving the flexible ring of FIG. 6A.

If pressed down a little bit, the ferrule 1 pushes the flexible ring 5A outwardly, then at this time, the lower part 11B of the ferrule protruding body will insert into the flexible ring 5A as shown in FIG. 6C.

Figure 6D:
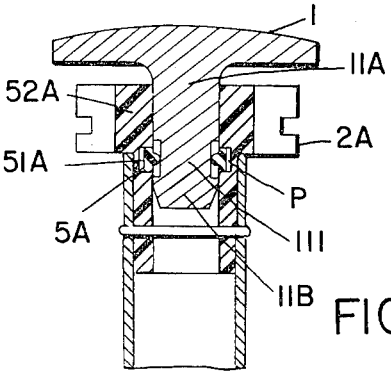
FIG. 6D is a sectional view of a coupling structure of the upper notch and the ferrule on an umbrella after the ferrule and the upper notch have been coupled to each other.

After the lower part 11B of the ferrule protruding body has passed through this flexible ring 5A as well as the middle part 111 of smaller diameter entered into the flexible ring 5A, and since the diameter of the middle part 111 is smaller than the inner diameter of the protruding ring 51A, said flexible ring 5A will no longer be pushed and has the ability to recover its original shape by means of its own flexibility as shown in FIG. 6D yet contracted out of the middle part 111 of the ferrule protruding body, consequently, there is a space p formed between flexible ring 5A and the ring-like groove 211A of the upper notch.

The coupling position of the ferrule 1 and the upper notch 2A is shown in FIG. 6D. The lower part 11B of the ferrule protruding body is stopped by flexible ring 5A, so the former will not easily drop out.

The seventh embodiment of the invention is shown in FIG. 7. The ferrule 6 (FIG. 7A) is also constituted integrally of upper, middle and lower parts, 611, 612 and 613 respectively. In the middle part, a groove 612A is formed to accept the flexible ring 7 (FIG. 7B). The lower part 513 has an arc and taper configuration. The diameters of the lower part 613 and middle part 612 are the same. The outer part of the flexible ring 7 has a flange 71. The diameter of this flange is bigger than the diameter of the lower part 613 of the ferrule, but smaller than or equal to the diameter of the upper part 611.

Figure 7A:
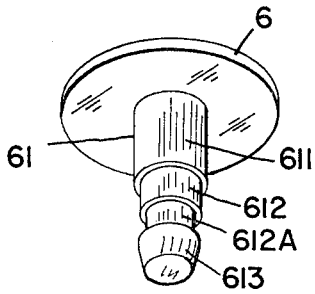
FIGS. 7A and 7B are perspective views of the ferrule and flexible ring of a seventh embodiment according to the invention.
Figure 7B:
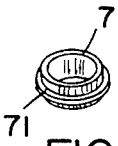
Figure 7D:
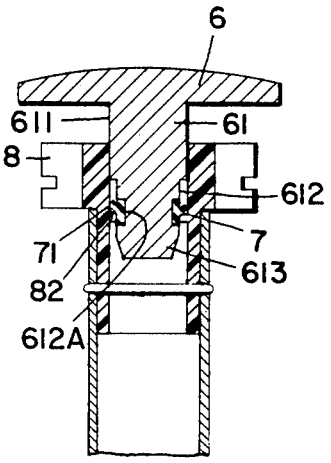
FIG. 7D is a longitudinally sectional view of the seventh embodiment of a coupling structure of the upper notch and the ferrule of the invention during their coupling procedure.
Figure 7C:
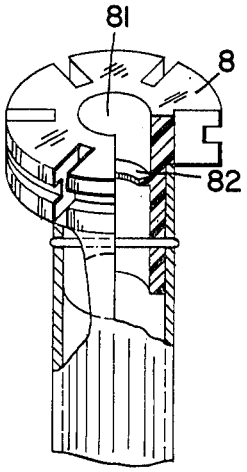
FIG. 7C is a perspective view of the upper notch of the seventh embodiment of this invention.

In order to fit the structure of the ferrule 6, an extrusive or projecting ring 82 is form in the middle hole 81 of the upper notch 8 (FIG. 7C). The inner diameter of this extrusive ring 82 is bigger than the diameter of the lower part 613 of the ferrule but smaller than the outer diameter of the extrusive flange 71 of the flexible ring.

Figure 7E:
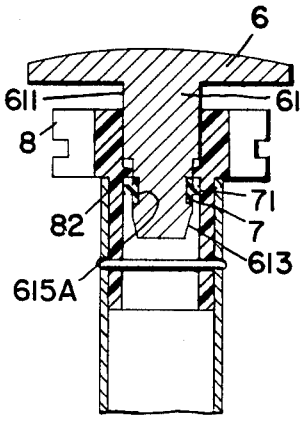
FIG. 7E is a longitudinally sectional view of the seventh embodiment of a coupling structure of the upper notch and the ferrule of the invention after they are fully coupled.

At the beginning of assembling, the ferrule 6 is inserted into the middle hole 81 of the upper notch 8. As shown in FIG. 7D, since the outer diameter of the lower part 613 of the ferrule 6 is smaller than the middle hole 81 and the extrusive ring 82 of the notch 8, the body 61 of the ferrule can easily be inserted into the middle hole 81, but stopped by extrusive ring 82 because the outer diameter of the extrusive flange 71 of the flexible ring 7 fitted into groove 612A of the ferrule is bigger than the inner diameter of the extrusive ring 82. After pushing the ferrule 6 harder, the extrusive flange 71 can be slightly deformed by its flexibility and entered into the lower position of the extrusive ring 82, then restored to its original shape by its flexibility again (as shown in FIG. 7E).

After the ferrule 6 is firmly coupled with the upper notch 8, since the extrusive flange 71 of the flexible ring 7 fitted in ferrule 6 is stopped by the extrusive ring 82 of the upper notch 8, they will not easily be uncoupled.

As mentioned hereinbefore, the present invention has the advantage that a single pressiug of the ferrule into the upper notch, will effect a non-loosing connection via the marvelous coupling of the upper notch and ferrule in accordance with the present invention.

In addition, it can be seen from the foregoing description, in the second embodiment as shown in FIG. 2 and the third embodiment as shown in FIG. 3, the insertion manner of the flexible ring-like means is of an unique structure which is applicable to either rigid or flexible ferrule and upper notch without any affect upon their coupling function.

It should be appreciated that other and further embodiments of the present invention may be devised without departing from the basic concept thereof.

What is claimed are:

1. A coupling structure for connecting a ferrule to a notch member of an umbrella comprising:

said notch member having an opening therein;

a projection extending from said ferrule engaged in said opening;

first means defining a stepped diameter area on one of said opening and projection; and second means defining a radially extending ring part on the other of said opening and projection engaged in said stepped diameter area;

said notch member being made of flexible material and being integrally formed with said radially extending ring part;

said projection including an upper portion having a diameter substantially corresponding to a diameter of said opening and a lower portion, said first means comprising a small diameter portion between said upper and lower portions of said projection;

said opening of said notch member having a large diameter upper part for engagement with said upper part of said projection and a smaller diameter lower part for engagement with said lower part of said projection, said radially extending ring part having an axially extending portion extending upwardly from said small diameter portion of said opening with a space defined between a radially outer end of said radially extending ring part and an inner surface of said large diameter portion of said opening, whereby said projection of said ferrule can be inserted into said opening to resiliently move said radially extending ring part first outwardly then, with said ferrule coupled to said notch member, said radially extending ring part moves radially inwardly into said small diameter portion through the resiliency of said radially extending ring part.

2. A coupling structure according to claim 1, including a substantially flat top portion connected to said upper portion of said projection to form said ferrule.

3. A coupling structure according to claim 1, wherein said lower portion is tapered outwardly toward said small diameter portion, a greatest diameter of said lower portion being less than the diameter of said opening.

4. A coupling structure according to claim 1, wherein said upper portion of said projection includes a plurality of circumferentially spaced concave areas.

5. A coupling structure according to claim 4, wherein said upper portion of said projection has large diameter areas between said concave areas, said lower portion of said projection being tapered outwardly toward said small diameter portion with a maximum diameter of said lower portion being less than the greatest diameter of said upper portion.

* * * * *